US009204684B2

(12) United States Patent
Hohmann

(10) Patent No.: US 9,204,684 B2
(45) Date of Patent: Dec. 8, 2015

(54) NOZZLE SHOE

(71) Applicant: Paul E. Hohmann, Taylors, SC (US)

(72) Inventor: Paul E. Hohmann, Taylors, SC (US)

( * ) Notice: Subject to any disclaimer, the term of this patent is extended or adjusted under 35 U.S.C. 154(b) by 64 days.

(21) Appl. No.: 14/106,797

(22) Filed: Dec. 15, 2013

(65) Prior Publication Data

US 2015/0164177 A1 Jun. 18, 2015

(51) Int. Cl.

| | |
|---|---|
| ***A63B 31/11*** | (2006.01) |
| ***A43B 5/08*** | (2006.01) |
| ***B63B 35/83*** | (2006.01) |

(52) U.S. Cl.

CPC .. *A43B 5/08* (2013.01); *B63B 35/83* (2013.01)

(58) Field of Classification Search

CPC ..... A43B 5/08; A63B 31/08; A63B 31/11; A63B 31/14; A63B 2031/112; A63B 2031/115; A63B 2031/117; B63H 16/00; B63B 35/83

USPC ..... 441/55, 60, 61, 64

See application file for complete search history.

(56) References Cited

U.S. PATENT DOCUMENTS

| | | | | |
|---|---|---|---|---|
| 2,889,563 | A * | 6/1959 | Lamb et al. | 441/64 |
| 5,387,145 | A * | 2/1995 | Wagner | 441/64 |
| 6,053,788 | A * | 4/2000 | Garofalo | 441/64 |
| 7,736,208 | B2 | 6/2010 | Bonis et al. | |
| 7,753,749 | B2 * | 7/2010 | Mun et al. | 441/64 |
| 7,997,948 | B2 | 8/2011 | Fraser et al. | |

* cited by examiner

*Primary Examiner* — Daniel V Venne

(74) *Attorney, Agent, or Firm* — Christopher J. Pfister

(57) ABSTRACT

A nozzle shoe includes water nozzles attached to the shoe. As water enters an inlet of each nozzle, it is directed through the use of turning vanes to an outlet of the nozzle. The internal turning vanes will aid in keeping the water in a substantially laminar condition for a more efficient performance while within the nozzle. The area of the outlet of the nozzle is smaller than the area of the inlet of the nozzle. This will provide a proportionally higher force out the outlet which will assist in propelling the wearer through the water at a higher velocity.

11 Claims, 8 Drawing Sheets

OUTSTEP OF SHOE
WITH INTERNAL
DIRECTIONAL VANES
SHOWN

NOZZLE SHOE

BACKGROUND OF THE INVENTION

The present general inventive concept relates to a nozzle shoe. More particularly, the present general inventive concept relates to a nozzle shoe configured for use in the water without fins.

Currently the most efficient method of propelling a person through the water is with the use of swim fins attached to the wearer's feet. The current design of swim fins, aside from slight alterations to the geometry and composition materials, has remained relatively unchanged since its invention.

Although the conventional design of swim fins does provide good forward thrust when swimming, such swim fins prove to be quite cumbersome or even dangerous to wear when out of the water. They are difficult to wear while walking on dry land and prove to be challenging to tread water in. Accordingly, a shoe is required which is efficient and effective both in and out of the water.

SUMMARY OF THE INVENTION

Features and utilities of the present general inventive concept provide a nozzle shoe adapted for use in the water without the use of fins.

Additional features and utilities of the present general inventive concept will be set forth in part in the description which follows and, in part, will be obvious from the description, or may be learned by practice of the general inventive concept.

Exemplary embodiments of the present general inventive concept provide a shoe adapted for water use by a wearer, the shoe including a plurality of nozzles configured to take in fluid during a kicking motion of the wearer and direct a flow of the fluid through the nozzles to propel the wearer during the kicking motion.

Each of the nozzles may include at least one vane connected to an intake, the vane adapted to direct the fluid from the intake towards an outlet configured to direct the flow of water in order to propel the wearer during the kicking motion.

A direction of the vanes may be preset according to the kicking motion.

The outlet of each nozzle may have a smaller area than the corresponding intake.

The vanes may be adapted to maintain the fluid in a substantially laminar condition as the fluid is moved from the intake to the outlet of the nozzles.

At least one of the plurality of nozzles may be mounted on a first side of the shoe, and at least one of the plurality of nozzles may be mounted on a second side of the shoe opposite the first side.

The intake of the at least one nozzle mounted on the first side of the shoe may be oriented in a first direction. The intake of the at least one nozzle mounted on the second side of the shoe may be oriented in a second direction different from the first direction.

The intakes of the nozzles mounted on the first and second sides of the shoe may be oriented in the same direction.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
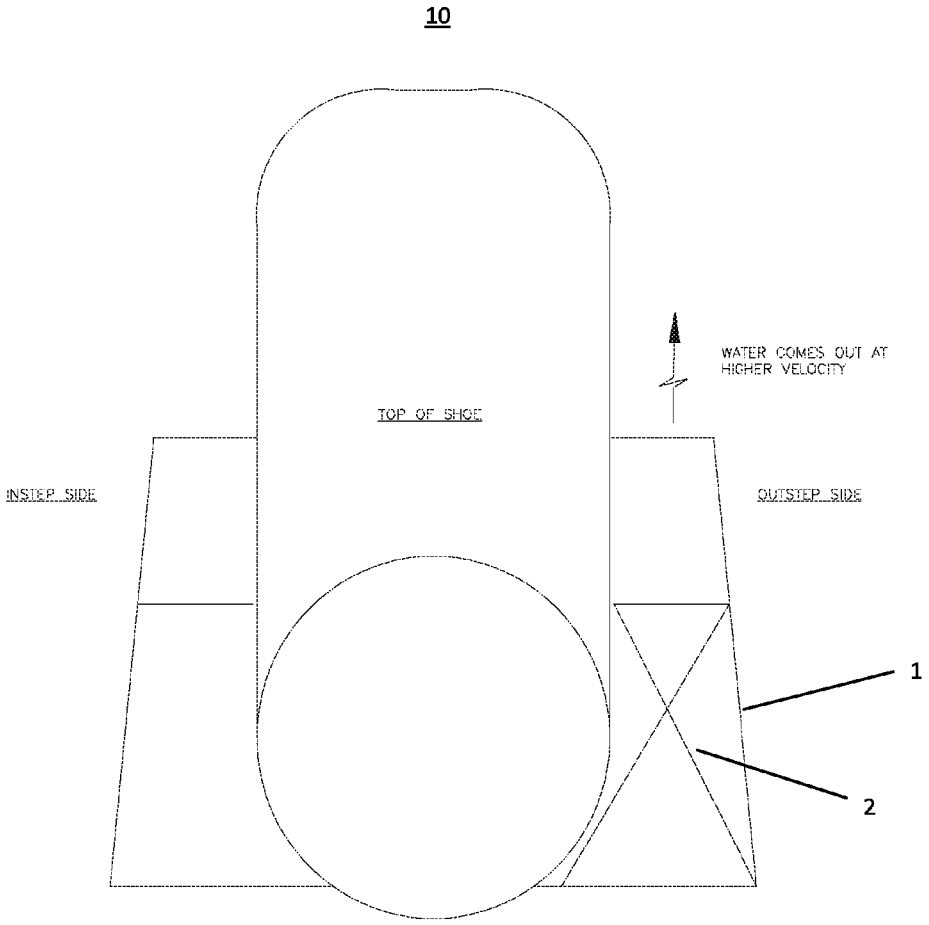
FIG. 1 is a top view illustrating a nozzle shoe according to an exemplary embodiment of the present general inventive concept.
Figure 2:
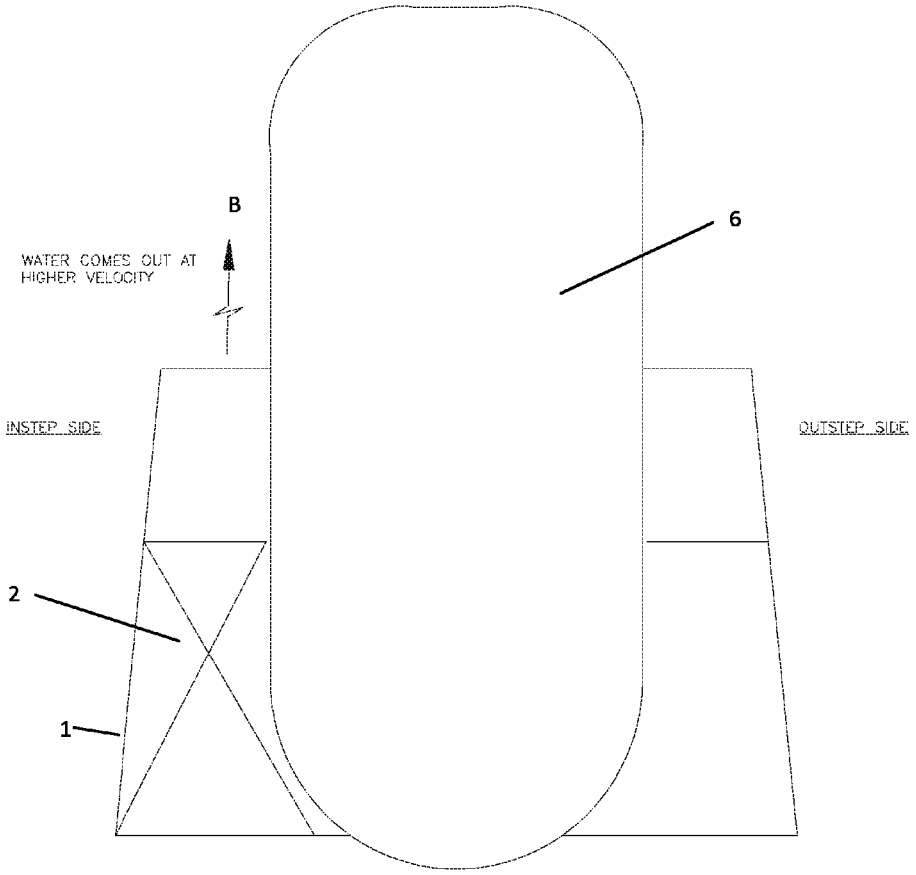
FIG. 2 is a bottom view illustrating a nozzle shoe according to an exemplary embodiment of the present general inventive concept.
Figure 3:
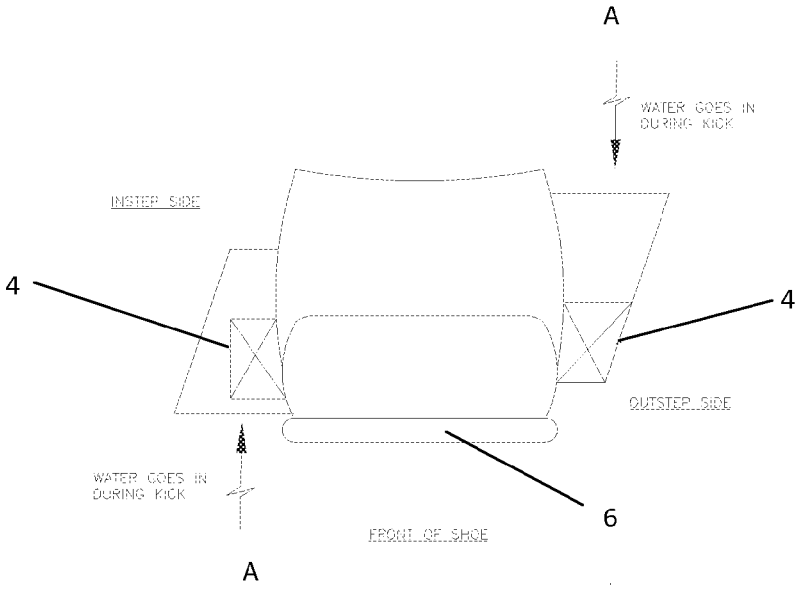
FIG. 3 is a front view illustrating a nozzle shoe according to an exemplary embodiment of the present general inventive concept.
Figure 4:
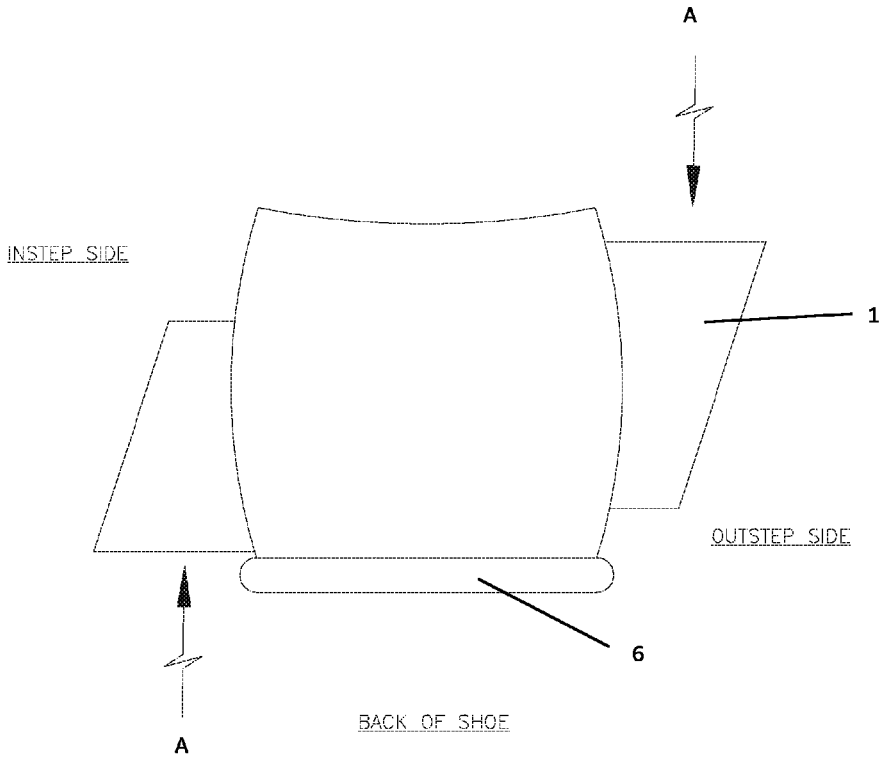
FIG. 4 is a rear view illustrating a nozzle shoe according to an exemplary embodiment of the present general inventive concept.

Reference will now be made in detail to the embodiments of the present general inventive concept, examples of which are illustrated in the accompanying drawings, wherein like reference numerals refer to like elements throughout. The embodiments are described below to explain the present general inventive concept by referring to the figures.

FIGS. 1-8 illustrate a nozzle shoe 10 according to an exemplary embodiment of the present general inventive concept.

A nozzle shoe 10 according to an exemplary embodiment of the present general inventive concept is a shoe designed for beach/water wear. It could be worn comfortably on the beach with a reduced hazard of tripping or falling as compared to a conventional shoe with swim fins, and still transfer directly into a functional mode in the water to help propel the wearer during a kicking motion.

Figure 5:
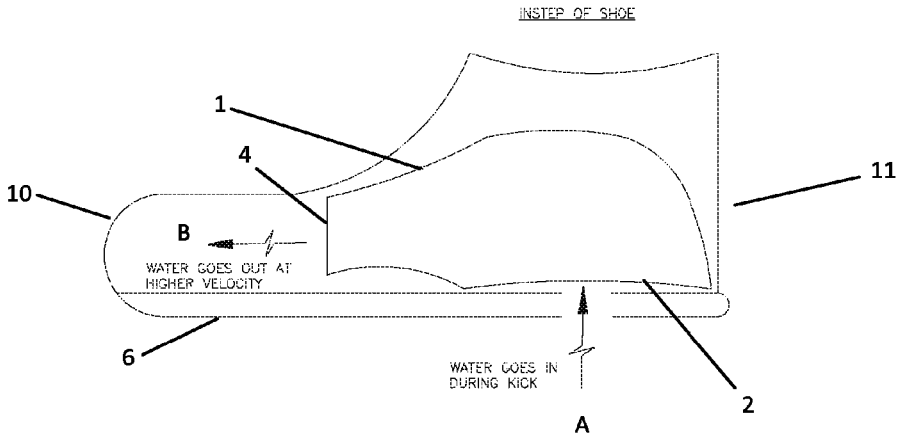
FIG. 5 is a view illustrating the instep of a nozzle shoe according to an exemplary embodiment of the present general inventive concept.
Figure 7:
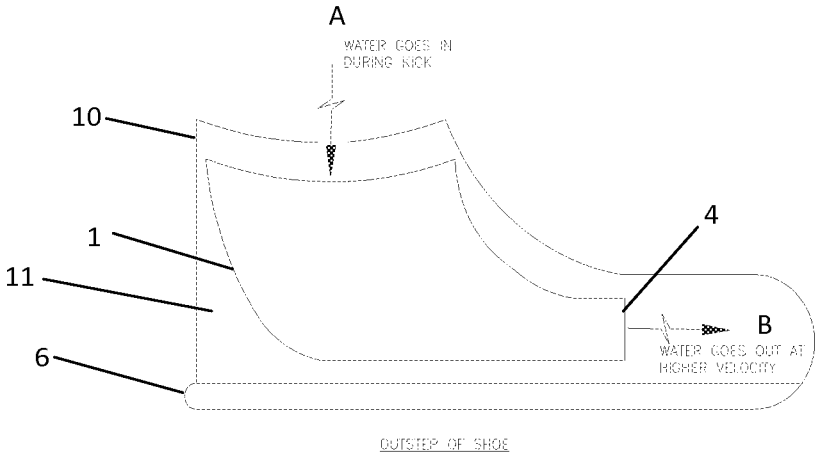
FIG. 7 is a view illustrating the outstep of a nozzle shoe according to an exemplary embodiment of the present general inventive concept.

An exemplary embodiment of a nozzle shoe 10 according to the present general inventive concept is adapted for beach and water wear. The nozzle shoe 10 includes vaned water nozzles 1 attached on either side of the nozzle shoe 10. As illustrated in FIGS. 5 and 7, the nozzles 1 may be attached at an ankle portion 11 of the nozzle shoe 10, the ankle portion 11 corresponding to a location of a wearer's ankle. The nozzles 1 may be made of a material such as rubber which is light and non-reactive to water, but also rigid enough to prevent deformation under extreme pressure. The nozzles 1 are designed to have a large inlet area, preferably divided over multiple inlets 2 in which water will be directed when the wearer kicks in a vertical motion. As the water enters the inlets 2, it is directed through the use of turning vanes 3 to the outlet 4 of the nozzle 1. The internal turning vanes 3 will aid in keeping the water in a laminar condition in which the water travels in a uniform direction, as opposed to a turbulent condition which is less orderly. Maintaining a laminar flow to the water passing through the nozzle thereby achieves a more efficient performance while the water is within the nozzles 1.

Figure 6:
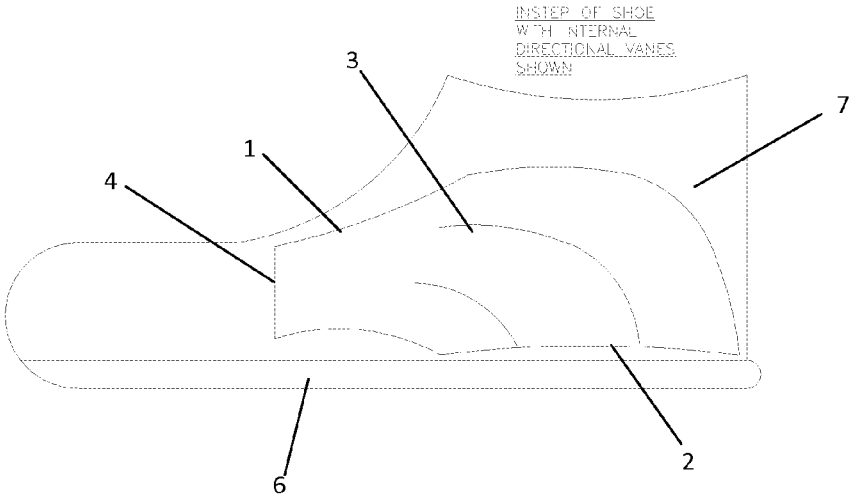
FIG. 6 is a view illustrating the direction of internal directional vanes of the nozzle shoe illustrated in FIG. 5.
Figure 8:
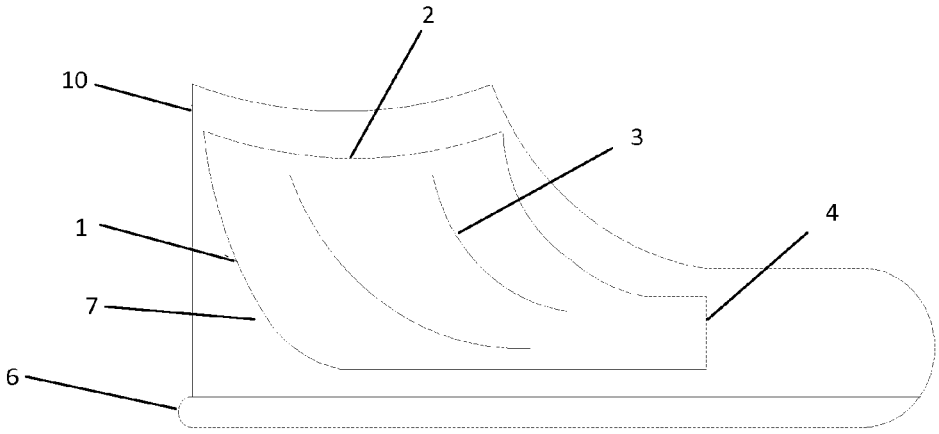
FIG. 8 is a view illustrating the direction of the internal directional vanes of the nozzle shoe illustrated in FIG. 6.

As illustrated for example in FIGS. 6 and 8, the area of the outlet 4 is much smaller than the total area of the inlets 2. This will provide a proportionally higher force out the outlet 4 which will assist in propelling a wearer of the nozzle shoe 10 through the water at a higher velocity.

During a kicking motion of the wearer, water enters the nozzles 1 of the nozzle shoe 10 through the inlets 2, traveling in intake direction A (see FIGS. 3-5 and 7). Water is directed through the vanes 3 and out the outlet 4, in output direction B (see FIGS. 1, 2, 5, and 7). In the exemplary embodiment illustrated in FIGS. 6 and 8, the vanes 4 direct the water through a bend or elbow 7 to change the flow direction of the water from the intake direction A to the output direction B. The water exiting the outlet 4 exerts a force which propels the wearer through the water during the kicking motion.

Since the nozzles 1 provide forward motion as described above, the nozzle shoe 10 does not require fins to propel the wearer through the water. As a result, the nozzle shoe 10 may be worn on dry land without encumbering or restricting the wearer's movement.

In the exemplary embodiment of the present general inventive concept illustrated in FIGS. 1-8, the inlet 2 of the nozzles 1 is oriented in different directions depending on which side of the nozzle shoe 10 the nozzle 1 is mounted on. As illustrated in FIGS. 5 and 7, the inlet 2 of the nozzle 1 on the instep of the nozzle shoe 10 (corresponding to the left side of a right shoe and the right side of a left shoe) is directed downwards towards the sole 6, while the inlet 2 of the nozzle 1 on the other side of the nozzle shoe 10 is directed upwards. This is to correspond to the directions of a kicking motion of a wearer. However, it will be understood that the orientation of the inlet 2 can be set to any orientation in which water will be drawn into the inlet 2 during a kicking motion.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

The invention claimed is:

1. A shoe, comprising:

a plurality of nozzles mounted on sides of the shoe to direct a flow of fluid during a kicking motion of a wearer, each of the plurality of nozzles comprising:

an inlet to take in fluid in an intake direction;

at least one internal vane comprising a bend to change a flow direction of the fluid from the intake direction to an output direction; and an outlet to expel the fluid from the at least one internal vane in the output direction.

2. The shoe of claim 1, wherein a direction of the at least one internal vane is preset according to the kicking motion.

3. The shoe of claim 1, wherein the outlet has a smaller area than the inlet.

4. The shoe of claim 2, wherein the at least one internal vane maintains the fluid in a laminar condition as the fluid is moved from the inlet to the outlet.

5. The shoe of claim 1, wherein at least one of the plurality of nozzles is mounted on a first side of the shoe, and at least one of the plurality of nozzles is mounted on a second side of the shoe opposite the first side.

6. The shoe of claim 5, wherein the inlet of the at least one nozzle mounted on the first side of the shoe is oriented in a first direction, and wherein the inlet of the at least one nozzle mounted on the second side of the shoe is oriented in a second direction different from the first direction.

7. The shoe of claim 5, wherein the inlets of the nozzles mounted on the first and second sides of the shoe are oriented in the same direction.

8. The shoe of claim 6, wherein:

the first direction and the second direction are opposite to each other.

9. The shoe of claim 1, further comprising:

a sole, wherein the inlet faces towards the sole.

10. The shoe of claim 1, further comprising:

a sole, wherein the inlet faces away from the sole.

11. The shoe of claim 1, wherein the plurality of nozzles are mounted at an ankle portion of the shoe, the ankle portion corresponding to a location of the wearer's ankle.

* * * * *